US005914197A

United States Patent [19]

Goudjil

[11] Patent Number: 5,914,197

[45] Date of Patent: Jun. 22, 1999

[54] ULTRAVIOLET ACTIVE WRISTBAND

[75] Inventor: Kamal Goudjil, Boulder, Colo.

[73] Assignee: Solartech Enterprises, LLC, Boulder, Colo.

[21] Appl. No.: 09/041,885

[22] Filed: Mar. 12, 1998

[51] Int. Cl.[6] ..... A44C 5/00; B32B 29/00

[52] U.S. Cl. ..... 428/537.5; 40/633; 250/372; 250/474.1; 359/241; 359/244; 428/913

[58] Field of Search ..... 40/633; 250/474.1, 250/372; 359/241, 244; 428/537.5, 913

[56] References Cited

U.S. PATENT DOCUMENTS

| | | | |
|---|---|---|---|
| 1,151,940 | 8/1915 | Gauvreau | 40/633 |
| 1,407,239 | 2/1922 | Weiss | 281/51 |
| 1,427,891 | 9/1922 | Ziegler | 40/633 |
| 4,122,947 | 10/1978 | Falla | 206/569 |
| 4,906,025 | 3/1990 | Schreindl | 281/45 |
| 4,980,089 | 12/1990 | Heller | 252/586 |
| 5,028,792 | 7/1991 | Mullis | 250/474.1 |
| 5,581,090 | 12/1996 | Goudjil | 250/474.1 |

*Primary Examiner*—D. S. Nakarani

[57] ABSTRACT

The present invention teaches an ultraviolet active wristband. The ultraviolet active wristband is made of the same materials as any wristband already in the market. However, the present wristband has the intriguing propriety of changing color reversibly from clear to any visible color (violet, blue, red, orange, yellow . . . ) when exposed to an ultraviolet source. The wavelength interval of the ultraviolet source is [250 nm–400 nm]. Therefore, it is also sensitive to the spectrum of ultraviolet sunlight that is [290 nm–400 nm]. The active chemical is a photochromic substance such as spiropyrans, spiroxazines.

5 Claims, 1 Drawing Sheet

ULTRAVIOLET ACTIVE WRISTBAND

STATEMENT AS TO RIGHTS TO INVENTIONS MADE UNDER FEDERALLY SPONSORED RESEARCH AND DEVELOPMENT

The present invention was conceived during the course of work supported by grant No. 1 R43 CA75887-01 from National Cancer Institute.

BACKGROUND OF THE INVENTION

1. Field of the Invention

The present invention relates to wristbands in general and more specifically to an ultraviolet active wristband using a photochromic compound which has been described in my earlier invention (U.S. Pat. No. 5,581,090). The photochromic compound is any molecule in the spiropyran or spiroxazine group.

2. Description of the Prior Art

Wristbands are used in many areas which include: Amusement parks and fun centers, College and university activities, Educational institutions activities, Fairs, Festivals and special events, Campgrounds, Parks and recreation, Night clubs, Bars and Taverns, Concerts, Promoters and Arenas, Resorts, Travel, Hotels and Motels, Sporting events and racetracks, Hospitals and health monitoring areas, Safety and special permit areas (government security areas).

The intended use of wristbands is oriented towards: Admission and gate control, Alcohol control, Group passes, Pay-one-price, Ride and concession tickets, VIP passes, Computerized admission, Backstage passes, Pit passes, Door prizes, Identification, Pre-ticket sales, Rental etc. . . .

The invention of wristbands is very old. Numerous patents have been issued relating to wristbands. Each invention has been designed to a specific use. For example, J. Gauvreau in U.S. Pat. No. 1,151,940, H. W. Weiss in U.S. Pat. No. 1,407,239, C. E. Ziegler in U.S. Pat. No. 1,427,891, and D. L. Schreindl in U.S. Pat. No. 4,906,025 disclose a wristband having an identification tag. In U.S. Pat. No. 4,122,947, M. B. Falla discloses a prepackaged patient identification kit and method for assuring correlation between a patient, his specimens and his records. The kit contains a wristband for identifying the patient. A similar system is marketed under the tradename IDENT-A-BAND by Hollister Incorporated of Libertyville, Ill. The IDENT-A-BAND system includes a wristband and a sheet of pressure sensitive labels. The sheet of labels includes a wristband label and other labels for specimen identification (c.f., Hollister Incorporated Products Catalogue). Precision Dynamics Corporation of San Fernando, Calif. manufactures numerous kinds of wristbands under the tradenames: VISABAND, SUPERBAND, SECURBAND, WATCHBAND, FUNBANDS, GLITTERBANDS. These wristbands are manufactured in different colors and shapes. Precision Dynamics most popular wristbands are the TYVEC Fiberbands. These feel and look like paper but are actually a strong, non-tearable fiber. In addition to TYVEC Fiberbands, Precision Dynamics Corporation manufactures plastic (e.g. Vinyl) wristbands. All the wristbands may be custom printed with different designs and colors (c.f., Precision Dynamics Corporation 1997 Products Catalogue).

The intent of this invention is not to create an already existing and well spread product but to create a color changing wristband. In other words, contrary to already marketed wristbands manufactured in a static color (red, blue, purple etc. . . . ) or fluorescent colors (glow in the dark), the present invention teaches a wristband capable of changing color from clear to an intense visible color (purple, blue, yellow, red etc. . . . ) upon exposure to ultraviolet radiation (e.g., sunlight or any ultraviolet lamp at check point). The present wristband is also capable of reversing back to its initial color state upon removed from the ultraviolet radiation source. It is therefore understandable that the present wristband may be used numerous times since it is reversible in color.

SUMMARY OF THE INVENTION

The object of the present invention is to provide an ultraviolet active wristband. The ultraviolet active wristband is made of the same materials as any wristband already in the market. However, the present wristband has the intriguing propriety of changing color from clear to any visible color (violet, blue, red, orange, yellow . . . ) when exposed to an ultraviolet source of energy. The wavelength interval of the ultraviolet source is [250 nm–400 nm]. Therefore, it is also sensitive to the spectrum of ultraviolet sunlight that is [290 nm–400 nm].

The present ultraviolet active wristband is able to go back to a clear state (non colored state) when not exposed to ultraviolet radiation. Therefore, the ultraviolet active wristband changes color reversibly allowing its reusability. This an important factor in determining that this invention is cost effective since it is not intended for a one time use only.

The ultimate objectives in creating ultraviolet active wristbands are:

1. As stated in my previous patent Photochromic Ultraviolet Detector, U.S. Pat. No. 5,581,090, the ability to monitor the ultraviolet intensity of sunlight. In the present invention this is achieved by simpler means: the use of a wristband. This is important for children since they are more susceptible to sunburn. It is well established that most skin damage occurs in the first 20 years of life. In addition, an ultraviolet active or solar active wristband is a very practical means of carrying an ultraviolet reminder. This is a powerful educational tool to enhance awareness in children as well as in adults of the presence of ultraviolet radiation in sunlight and the role this radiation plays in skin damage in general and skin cancer in particular.

2. As stated previously, wristbands may be used as means to control admission, to discourage underage alcohol drinking, to create special passes for special areas (gate control) or generally any type of identification in areas such as amusement parks and fun centers, college and university activities, educational institutions activities, fairs, festivals and special events, campgrounds, parks and recreation, night clubs, bars and taverns, concerts, promoters and arenas, resorts, travel, hotels and motels, sporting events and racetracks, hospitals and health monitoring areas, special permit areas (government security). The present invention allows to accomplish these tasks in a more efficient way by providing an ultraviolet sensitive wristband that can be easily distinguished over other wristbands.

Although the idea of incorporating ultraviolet sensitive chemicals in polymer matrices such as acrylics, vinyls, cellulosics, epoxies, polyesters, polystyrenes, alkyds, polyamides (nylons), polyurethanes, polycarbonates etc. . . . has been already suggested in other inventions (c.f., my invention, U.S. Pat. No. 5,581,090 and the references listed therein), the present invention is an extension of my previous inventions where I discussed the use of photochromic chemicals as ultraviolet sensitive media in various applications. Photochromic substances are known in the art for their utilization in optics. Among the large family of photochromic compounds figure two families of molecules called spiropyrans and spiroxazines. These molecules are well known for their property of photo-reacting to ultraviolet light [250 nm–400 nm] by changing from clear to a variety of colors and shades. The spiro-compounds appear as colorless form but undergo a photochemical transformation under UV radiation to an intensely colored form. A detailed description of the chemical and physical characteristics of these compounds has been given in the U.S. Pat. No. 5,581,090 and the references cited therein. The intensity of the resulting visible color (blue, violet, red . . . ) is directly proportional to the intensity of the UV light source: the more intense the UV light the more intense the resulting visible color is.

The present invention: Ultraviolet Active Wristband is further described as the incorporation of photochromic compounds into different substrate materials that are shaped to form a wristband.

One form of incorporating photochromic chemicals onto a substrate material is through the use of an ink vehicle. The ink vehicle is chosen to be a clear ink formulation containing basic clear polymers such as: acrylics, cellulosics (e.g., cellulose acetate, cellulose acetate butyrate and cellulose acetate propionate), Vinyls: poly(vinyl butyral), poly(vinyl chloride), poly(vinyl acetate) and polyurethanes or a composition of these polymers. The ink composition containing photochromic chemicals is applied on a substrate material such as plastics, paper or any type of fiber material such as TYVEC to form a thin layer that is sensitive to ultraviolet radiation. The resulting layer is clear when unexposed to an ultraviolet source (e.g. sunlight, UV lamp). However, as soon as exposed to UV radiation, the layer undergo a photo-transformation by turning into a visible color (blue, violet, red, yellow . . . ). The color depends on the nature and the chemical formula of photochromic molecule (spiroxazine or spiropyran).

The other form being the incorporation of the photochromic compound directly into the polymer matrix. This process involves the technique of injection molding of plastics.

The photochromic chemical is mixed with plastic beds prior to introduction into an injection-molding machine and then molded to form a polymer medium exhibiting a photochromic behavior. Examples of suitable plastics host material are optically clear plastics which include polyol(allyl carbonate)-monomers, polyacrylates, polyethylene, polypropylene, polyvinyl chloride, polymethyl methacrylates, cellulose acetate, cellulose triacetate, cellulose acetate propionate, cellulose acetate butyrate, polyacetal resin, acetyl cellulose, poly(vinyl acetate), poly(vinyl alcohol), polyurethanes, polycarbonates, polystyrene, poly (styrene methylmethacrylate) coopolymers, poly(styrene acrylonitrile) coopolymers, and polyvinylbutyral.

DESCRIPTION OF THE PREFERRED EMBODIMENT

Figure 1:
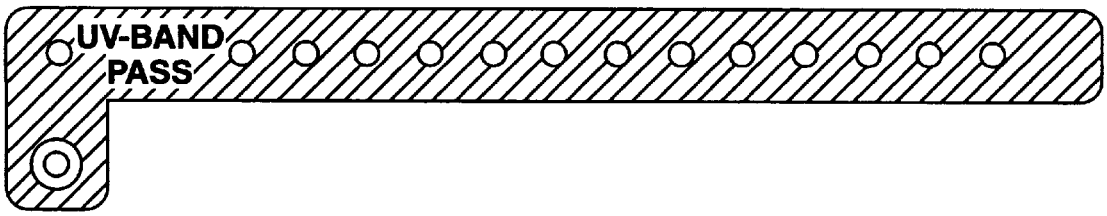
FIG. 1. Shows the embodiment of the ultraviolet active wristband, where the photochromic ink composition is applied on a wristband of various substrates such as paper, TYVEC and plastics.

In accordance to the present invention, an ultraviolet active wristband is manufactured to allow direct sensing of ultraviolet radiation by a simple change of color. A change of color from clear to a visible color will occur as soon as the wristband is exposed to a UV radiation [250 nm–400 nm] source or may be activated as soon as exposed to sunlight [290 nm–400 nm]. The present invention will be explained below through the use of embodiments.

Embodiment 1

A photochromic molecule is mixed with an acrylic coating or any clear coating such as, but not limited to, cellulosics (e.g., cellulose acetate, cellulose acetate butyrate and cellulose acetate propionate), poly(vinyl butyral), poly(vinyl chloride), poly(vinyl acetate), epoxies and polyurethanes, in the proportion of 0.2 to 1.5% in weight. In particular the ink GV170 supplied by Nazdar Corporation is used in conjunction with the photochromic compound spiroxazine or spiropyran to form a mixture sensitive to UV radiation that can adhere to different surfaces. The GV170, a vinyl base ink is used in screen printing on plastics, papers, TYVEC (a fibrous material resembling paper but more resistant to shredding). The GV170 ink contains the following compounds: Isophorone (25–45% by weight), Petroleum distillate or Aromatic Hydrocarbon (5–10% by weight), Ethyl 3-Ethoxypropionate (5–10% by weight), Diacetone Alcohol (0–10% by weight), Naphthalene (<2% by weight), Vinyl Acetate (<1% by weight) and a vinyl polymer (% not disclosed).

This ink offer a good binder as it does not induce a bathochromic shift on the spiroxazine molecule. The bathochromic shift is a shift in the absorption spectrum due to the polarity of the host material. This phenomenon has been explained in detail in my previous invention (U.S. Pat. No. 5,581,090).

The said mixture is applied on paper or plastic by means of traditional screen printing techniques. Upon drying, the substrate material (paper, plastic, TYVEC or any other type of smooth surface) is irradiated with UV light. The substrate exhibits an immediate change of color in the visible part of the spectrum. The intensity of the visible color is directly proportional to the UV light intensity. The substrate went back to its colorless form when it is removed from the UV source (e.g. sunlight, ultraviolet lamp, blacklight lamp etc. . . . ).

Embodiment 2

Another method for creating an ultraviolet active wristband is by incorporating the photochromic compound directly into the polymer matrix. This process involves the technique of injection molding of plastics. The photochromic chemical is mixed with plastic beds prior to introduction into an injection-molding machine and then molded to form a polymer medium exhibiting a photochromic behavior. Examples of suitable plastics host material are optically clear plastics which include polyol(allyl carbonate)-polymers, polyacrylates, polyethylene, polypropylene, polyvinyl chloride, polymethyl methacrylates, cellulose acetate, cellulose triacetate, cellulose acetate propionate, cellulose acetate butyrate, polyacetal resin, acetyl cellulose, poly (vinyl acetate), poly(vinyl alcohol), polyurethanes, polycarbonates, polystyrene, poly(styrene methylmethacrylate) coopolymers, poly(styrene acrylonitrile) coopolymers, and polyvinylbutyral.

Injection molding or extrusion molding is a process that continuously forms a particular shape by forcing a heated polymeric material through a calculated opening in a die in order to produce a desired finished cross section. The main application of extrusion is the production of continuous lengths of film, sheeting, pipe, filaments, wire jacketing, and other useful forms and cross sections. After the plastic melt has been extruded through the die, the extruded material is hardened by cooling, usually by air or water. The produced plastic material may later be cut to extract any desired shape. For example, a wristband may be cut from the said formed plastic material. As it has been pointed earlier the formed clear plastic contains a photochromic chemical enabling the material to change color from clear to a visible color such as red, violet, blue etc. . . . in presence of ultraviolet light. Therefore, a wristband cut from this plastic material will exhibit the same properties of color change upon exposure to ultraviolet radiation. To allow a better visualization of the visible color, it is recommended to lay down the clear wristband on a white background.

As it has been pointed out in my previous inventions the photochromic substance has a limited life time due to oxidation processes. The adjunction of UV stabilizers are recommended. After performing testing on different stabilizers available in the market, TINUVIN 765 and TINUVIN 144 Hindered Amine Light Stabilizers, supplied by Ciba, Additive Division, have been selected for their performance under sunlight. The stabilizers are added in a proportion of 2.5% to 3% in weight. TINUVIN 765 product has the following chemical formula: bis(1, 2, 2, 6, 6-Pentamethyl-4-piperidinyl) sebacate in (75–85% by weight) and Methyl (1, 2, 2, 6, 6-pentamethyl-4-piperidinyl) sebacate in (15–25% by weight). The chemical formula for TINUVIN 144 is: bis(1, 2, 2, 6, 6-Pentamethyl-4-piperidynyl) (3,5-di-tert-butyl-4-hydroxybenzyl) butylpropanedioate. The Hindered Amine Light Stabilizers are incorporated in the photochromic composition so as to be in close physical proximity to the organic photochromic compounds imbedded in organic matrices (clear polymers). For more increased stability, anti-oxidants may be added to the polymeric matrix. For example, IRGANOX chemicals supplied by Ciba are chosen for their ability to effectively inhibit oxidation and thermal degradation of many organic and polymeric materials. IRGANOX 1076 with the chemical name Octadecyl 3,5-di-tert-butyl-4-hydroxyhydrocinnamate, and IRGANOX 259 with the chemical name Hexamethylene bis(3,5-di-tert-butyl-4-hydroxyhydrocinnamate) supplied by Ciba Additive division have been tested. Anti-oxidant chemicals are added in proportion of 1% to 2% by weight to the polymeric matrix.

While the invention has been particularly shown and described with reference to preferred embodiments, it will be understood by those skilled in the art that various changes in form or in detail may be made therein without departing from the spirit and scope of the invention. For instance, the present ultraviolet active wristband may be used around the ankle instead of the wrist or attached to a handle of any kind (e.g., luggage handle, bicycle frame, around the rear view mirror of a vehicle, etc. . . . )

I claim:

1. An ultraviolet active wristband comprising:

(a) a substrate material selected from the group consisting of paper and plastic, and, (b) a clear ink composition comprised of an ink vehicle used in screen printing, and, of 0.2% to 1.5% in weight photochromic compound selected from spiroxazine molecules or spiropyran molecules;

wherein said ink composition is applied to the said substrate to form a wristband sensitive to ultraviolet radiation.

2. The clear ink composition of claim 1, further comprising:

(c) anti-oxidants consisting of Hindered Amine Light Stabilizers and Hindered Phenolic Anti-oxidants;

wherein said anti-oxidants are used in concentration between 1% to 3% by weight of the total ink composition.

3. The clear ink composition of claim 1 is applied onto a substrate material selected from the group consisting of plastic and paper by means of known screen printing techniques.

4. An ultraviolet active wristband comprising:

(a) a polymer matrix selected from the group consisting of optically clear plastics, and, (b) a photochromic compound selected from the group consisting of spiroxazine and spiropyran molecules;

wherein said photochromic compound is mixed to the said polymer matrix and molded by means of injection and extrusion molding techniques to form a wristband sensitive to ultraviolet radiation.

5. The ultraviolet active wristband of claim 4, further comprising:

(c) anti-oxidants consisting of Hindered Amine Light Stabilizers and Hindered Phenolic Anti-oxidants;

wherein said anti-oxidants are used in concentration of 1% to 3% by weight of the total polymeric matrix.

* * * * *